United States Patent [19]

Sakai et al.

[11] Patent Number: 4,987,852

[45] Date of Patent: Jan. 29, 1991

[54] APPARATUS FOR REMOVING BUBBLES IN PAINT AND A PAINT COATING SYSTEM INCLUDING THE BUBBLE REMOVING APPARATUS

[75] Inventors: Tomoharu Sakai, 1-16-103, Asahigaoka, Toyonaka-shi, Osaka; Eizo Yoshida, Kyoto; Hiroshi Mihara, Nara; Toshio Adachi, Osaka, all of Japan

[73] Assignees: Tomoharu Sakai, Toyonaka; Dai Nippon Toryo Co., Ltd., Osaka; Meishin Kabushiki Kaisha, Osaka, all of Japan

[21] Appl. No.: 378,774

[22] Filed: Jul. 12, 1989

[51] Int. Cl.[5] ..... B05C 11/00

[52] U.S. Cl. ..... 118/603; 118/610; 55/190; 55/165

[58] Field of Search ..... 55/189, 190, 165, 166; 118/602, 603, 610, 612

[56] References Cited

U.S. PATENT DOCUMENTS

| | | | |
|---|---|---|---|
| 1,031,942 | 7/1912 | Leblanc | 55/55 |
| 1,910,088 | 5/1933 | Cherry | 55/165 |
| 2,006,985 | 7/1935 | Claude et al. | 55/55 |
| 2,797,767 | 7/1957 | Brooke et al. | 55/55 |
| 3,793,805 | 2/1974 | Hoffman | 118/610 |

*Primary Examiner*—Bernard Nozick

*Attorney, Agent, or Firm*—Oblon, Spivak, McClelland, Maier & Neustadt

[57] ABSTRACT

An apparatus for removing bubbles in paint comprises a sealed container having an upper section and a lower section divided by a plate having one or more slit-like through holes and a pressure reducing device connected to the lower section. A paint coating system includes the bubble removing apparatus, a tank for storing a new paint, a first pipe line to feed paint from the tank to the upper section of the sealed container, a curtain flow coater or a roll coater communicated with the lower section of the sealed container so as to receive paint without bubbles, and a vessel to collect paint which does not contribute to form a coating layer.

7 Claims, 4 Drawing Sheets

APPARATUS FOR REMOVING BUBBLES IN PAINT AND A PAINT COATING SYSTEM INCLUDING THE BUBBLE REMOVING APPARATUS

BACKGROUND OF THE INVENTION

1. Field of the Invention

The present invention relates to an apparatus for removing bubbles in paint and a paint coating system having such an apparatus in which paint subjected to bubble-removing operations in the bubble removing apparatus is supplied to a paint coating device.

2. Description of the Related Art

There has been widely practiced the operations of cutting, perforating and bending of a metallic plate to form structural elements having desired shape and dimensions for various apparatuses and appliances.

Paint coating has often been applied to such structural elements in order to improve the outer appearance and give rust-preventing function. Heretofore, the paint coating to the metallic elements has been carried out after a metallic sheet has been worked by machining and so on so that they have a predetermined shape and dimensions. However, the metallic structural elements after they have been processed by machining generally had complicated steric shapes, and therefore, paint coating operations were troublesome; much amount of paint was needed, and manufacturing cost was pushed up.

Recently, there has been carried out a method that a metallic plate is previously coated at its entire surface with paint to obtain a pre-coated metal (PCM) and the PCM is processed by machining to manufacture the structural elements. In such method that the paint is applied uniformly to the entire surface, loss of the paint can be minimized and excellent paint coating is obtainable. Accordingly, manufacturing steps can be shortened in view of the entire process of the manufacturing of the structural elements in addition to saving energy and resources.

In manufacturing the PCM, a paint coating method such as a curtain flow coating method, a roll coating method is desirably used because the continuous formation of a coating layer can be obtained efficiently and quickly.

Paint generally has a high viscosity and often contains bubbles during manufacturing steps. When the paint in which bubbles are contained is used for painting, pin holes may be produced in a coated layer and a curtain-like coating layer may be broken when the curtain flow coating method is used, whereby stable, excellent paint coating can not be obtained. Therefore, it is necessary to remove bubbles in paint prior to the painting operation.

Such treatment of removing bubbles has been carried out in such a manner that bubbles in paint are expanded by reducing pressure in a sealed container containing the paint to thereby float the expanded bubbles on the free surface, so that the floating bubbles are broken.

However, the above-mentioned pressure reducing operations were insufficient to remove the bubbles in a short time because the viscosity of paint is fairly high. Therefore, it was difficult to supply a sufficient amount of paint, which has been subjected to the bubble-removing operation, to a paint coating device at a high feeding rate. In view of the above, there have been taken such measures that (1) paint is forcibly agitated, (2) a high speed vortical stream is resulted in paint, or (3) ultrasonic waves are applied to paint, in order to increase a rate of removing bubbles under a reduced pressure.

However, when the bubble removing operation using the above-mentioned acceleration method of (1) was taken, the rate of removing bubbles would not be sufficiently reduced. Further, a continuous treatment was difficult because it utilizes a batch process. In the case of the bubble removing operations using the method of (2), solid components such as pigment were apt to be separated due to the centrifugal force of the vortical stream. Further, a continuous treatment was difficult. In the bubble removing operations using the acceleration method of (3), there was easily caused the agglomeration of solid components such as pigment by the action of the ultrasonic waves. Further, the continuous treatment was difficult. In the above-mentioned methods, efficiency of the breaking of the floating bubbles was also low.

Accordingly, in an attempt to construct a paint coating system for manufacturing the PCM by combining the conventional bubble removing apparatus and a paint coating device, it was necessary to previously remove bubbles in paint by a bubble removing apparatus having a large capacity when paint coating was to be continuously carried out. In this case, the paint which was subjected to the bubble removing operations has to be stored in the apparatus. Accordingly, a large-sized bubble removing apparatus and a paint storing container were needed, and the size of a paint coating system could not be reduced. Further, when a conventional bubble removing apparatus was to be used, the quality of paint decreased depending on a bubble removing method, hence the quality of a coated layer was reduced.

SUMMARY OF THE INVENTION

It is an object of the present invention to eliminate the above-mentioned problems and to provide a bubble removing apparatus for paint capable of allowing a continuous operation and of removing bubbles at a high removing rate without impairing the quality of the paint, a paint coating system with the bubble removing apparatus which can form a coating layer having excellent quality.

In accordance with the present invention, there is provided an apparatus for removing bubbles in paint which comprises a sealed container having an upper section and a lower section, a plate having at least one slit-like through hole which is disposed in the container to divide the container into the upper and lower sections, and a pressure reducing means connected to the lower section.

In accordance with the present invention, there is provided a system for coating paint which comprises:

a tank for storing a new paint material, a bubble removing apparatus comprising a sealed container, a plate having at least one slit-like through hole which is disposed in the sealed container to divide the same into upper and lower sections and a pressure reducing means connected to the lower section of the container, a first paint feeding means to feed paint from the tank to the upper section of the sealed container, a paint coating device communicated with the lower section of the sealed container so as to receive paint without bubbles, and a paint recovering means which is adapted to recover or collect the paint which does not contribute to form a coating layer.

DESCRIPTION OF THE PREFERRED EMBODIMENTS

Several embodiments of the present inventions will be described with reference to the drawings.

Figure 1:
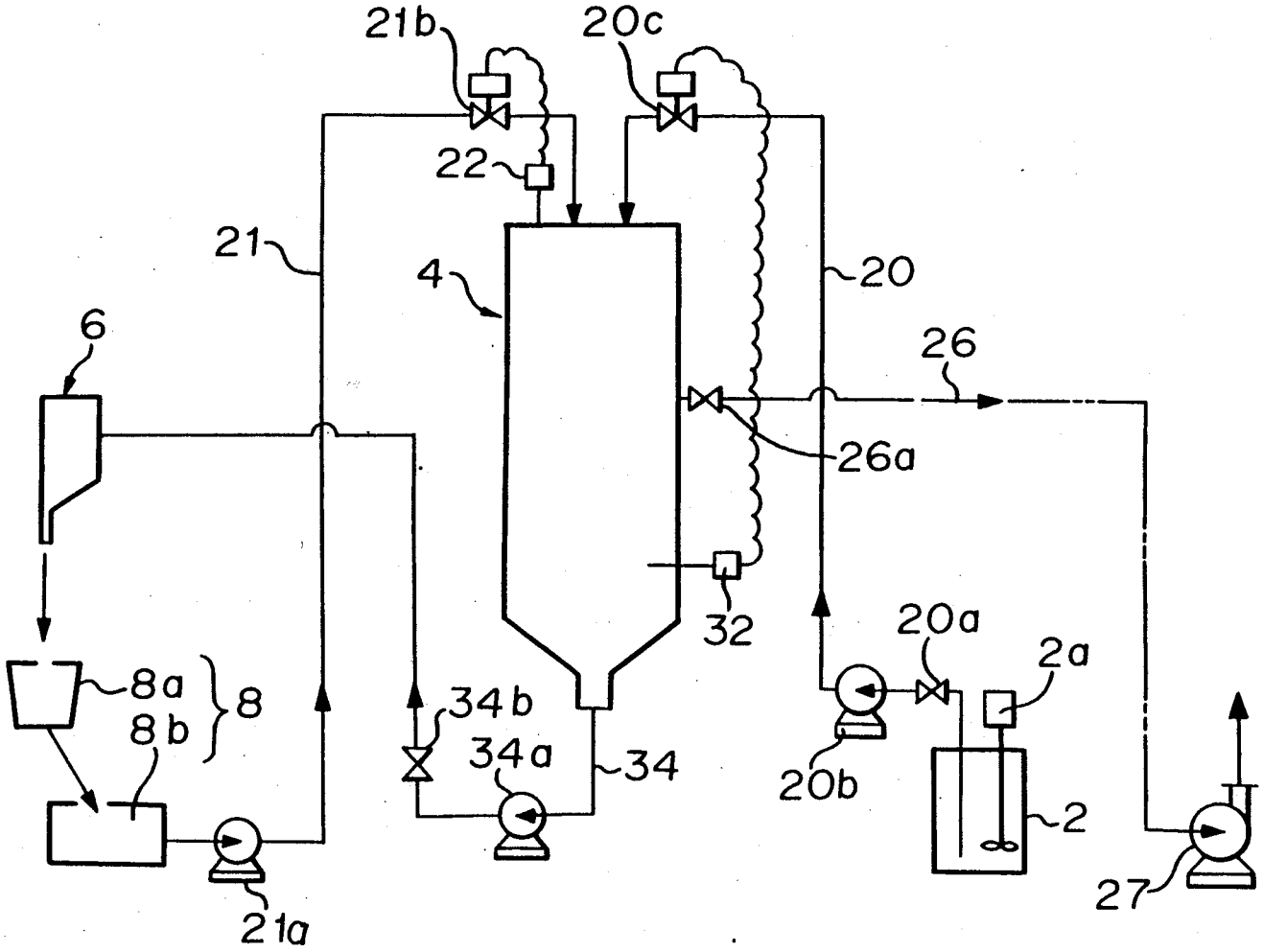
FIG. 1 is a diagram showing an embodiment of a paint coating system according to the present invention.

FIG. 1 is a diagram showing an embodiment of the paint coating system according to the present invention.

In FIG. 1, a reference numeral 2 designates a tank containing fresh paint, a numeral 4 designates an apparatus for removing bubbles in paint (hereinbelow, referred to as a bubble removing apparatus), a numeral 6 designates a paint coating device, and a numeral 8 designates a paint recovering means which is adapted to recover or collect the paint which does not contribute to form a coating layer.

The tank 2 is provided with an agitating means 2*a* which agitates paint contained in the tank 2 to make it uniform.

Figure 2:
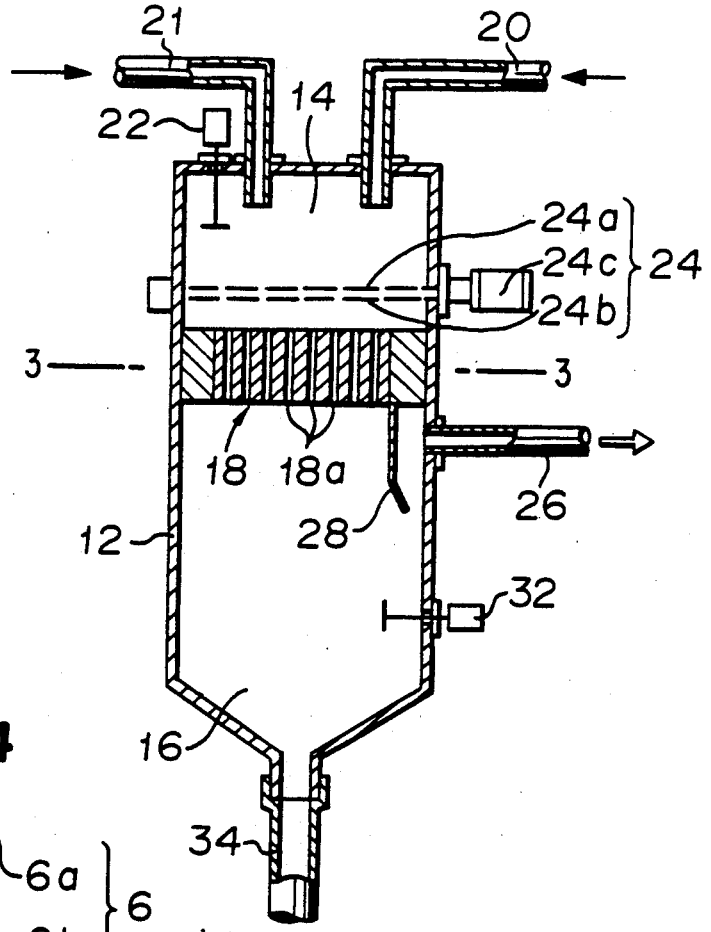
FIG. 2 is a longitudinal cross-sectional view showing an embodiment of the bubble removing apparatus according to the present invention.
Figure 3:
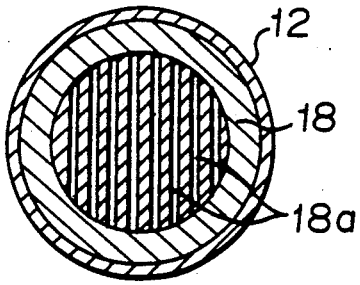
FIG. 3 is a cross-sectional view taken along a line A—A of FIG. 2.

The bubble removing apparatus 4 has a construction as shown in FIGS. 2 and 3.

FIG. 2 is a longitudinal cross sectional view of the bubble removing apparatus 4 and FIG. 3 is a cross-sectional view taken along a line A—A.

In FIGS. 2 and 3, a numeral 12 designates a cylindrical sealed container which is divided into an upper section 14 and lower section 16 by means of a plate 18 having slit-like through holes 18 *a*. The plate is provided with a plurality of slits 18*a* arranged with appropriate intervals as shown in FIG. 3. The width of each of the slits 18*a* may be determined as desired so that the paint contained in the container passes at a suitable flow rate in order to form thin films depending on the viscosity and other conditions for the paint. For instance, the width of the slits is determined in a range of 20 μm–2,000 μm, preferably 50 μm–800 μm. The spaces between each of the slits and the thickness of the plate having slit-like through holes 18 may be determined as desired depending on conditions for treating the paint.

A numeral 20 designates a pipe line to feed the paint in the tank 2 to the upper section 14 of the sealed container, which is provided as shown in FIG. 1 with a first flow rate regulate valve 20*a*, a pump 20*b* and a second flow rate regulate valve 20*c* at suitable positions in the pipe line 20.

A numeral 21 is a pipe line to feed the paint from the recovering means 8 to the upper section 14 of the sealed container, which is provided as shown in FIG. 1 with a pump 21*a* and a third flow rate regulate valve 21*b* at suitable positions in the pipe line 21.

A numeral 22 designates a level guage to detect the surface level of the paint introduced in the upper section 14 of the sealed container. The degree of opening of the third flow rate regulate valve 21*b* in the pipe line 21 is determined on the basis of detection by the level guage 22.

A numeral 24 designates an air-tight degree adjusting means for adjusting pressure in the upper section 14 of the sealed container. The adjusting means comprises two panels 24*a*, 24*b* each having a pattern of opening corresponding to each other and which is relatively movable in the horizontal direction in a contacting state and a driving means 24*c* to determine the positions in the horizontal direction of the panels. At least one of the two panels 24*a*, 24*b* is moved in the horizontal direction by means of the driving means 24*c*, and a pattern of opening is formed at a position that the openings of the panels are partially or entirely overlapped. By suitably adjusting the surface area of the openings, the air-tight degree can be adjusted. The air-tight degree adjusting means 24 possesses function to supply paint on the upper surface of the plate having slit-like through holes 18 uniformly. The air-tight degree adjusting means 24 may be omitted when a desired condition can be obtained in the upper section of the sealed container.

A pipe line 26 is attached to the sealed container at a position corresponding to the lower section 16 of the container so that the lower section 16 is evacuated to reduce the pressure. A pressure reducing source such as a vacuum pump 27 is connected to the pipe line 26, and a pressure adjusting valve 26*a* is interposed in the pipe line 26.

A partition plate 28 is disposed in the lower section 16 of the container 12 at the position corresponding to the opening of the pipe line 26, whereby it separates the opening of the pipe line 26 from streams of paint falling through the slits 18*a* formed in the plate 18.

A level guage 32 is disposed at the lower section 16 of the container to detect the surface level of paint introduced in the lower section 16. The degree of opening of the second flow rate regulate valve 20*c* in the pipe line 20 is determined by the level guage 32.

A pipe line 34 is connected to the lower end of the lower section 16 of the sealed container to supply the paint which has been subjected to a bubble removing treatment to the paint coating device 6. A pump 34*a* and a flow rate regulate valve 34*b* are respectively interposed in the pipe line 34.

Figure 4:
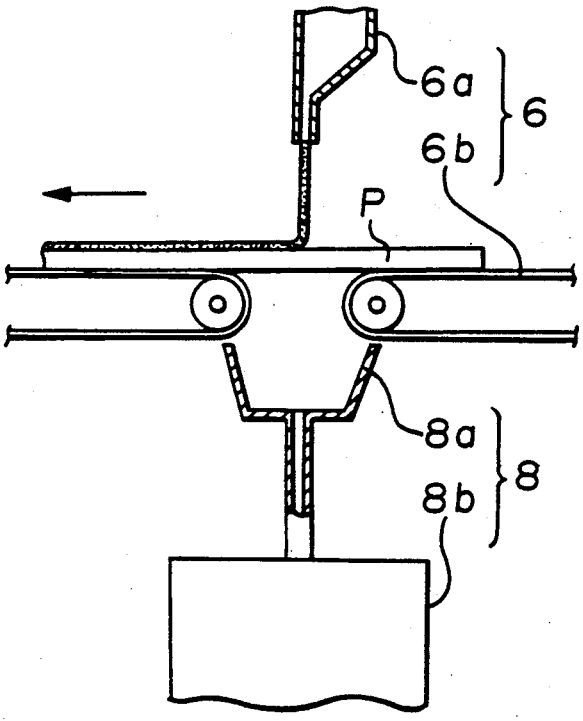
FIG. 4 is a longitudinal cross-sectional view of an embodiment of a paint coating device and a paint recovering means according to the present invention.

FIG. 4 illustrates schematically the paint coating device 6, specifically a curtain flow coater and the paint recovering means 8.

The paint coating device 6 comprises a flow coater head 6*a* and a belt conveyor 6*b* disposed below the head 6*a*, and a metal plate P as a material to be coated with paint is transferred on the belt conveyor 6*b* in the direction indicated by the arrow mark.

The paint recovering means 8 comprises a trough 8*a* disposed just below the flow coater head 6*a* and below a space formed between neighboring conveyors 6*b* and a vessel 8*b* to receive paint in it. A pipe line 21 is connected between the vessel 8*b* and the upper section of the sealed container 12. However, the pipe line 21 may be omitted.

Figure 6:
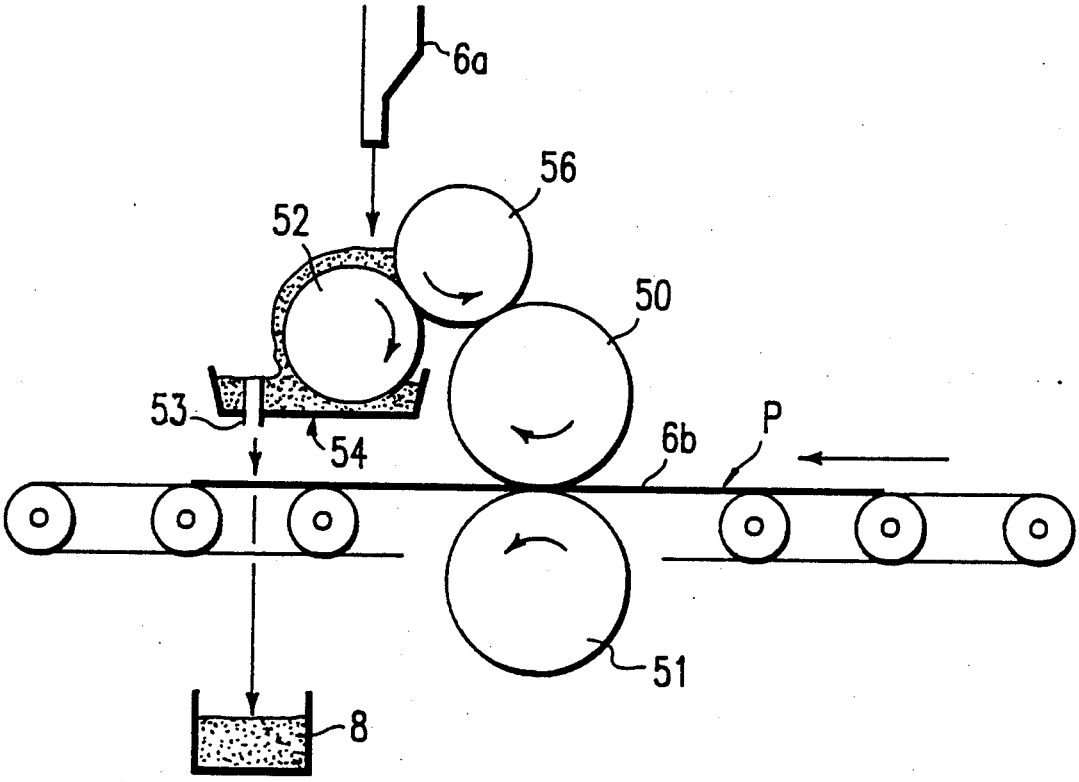
FIG. 6 illustrates a paint coating device in the form of a roll coater.

A roll coater as illustrated in FIG. 6 may be used for the paint coating device in the same manner as the curtain flow coater.

The operation of the paint coating system having the construction described above will be described.

First of all, all the valves in the pipe lines communicated with the bubble removing apparatus 4 are closed except for the valve 26a. The vacuum pump 27 is actuated to evacuate air in the bubble removing apparatus 4 so that pressure in the apparatus is reduced to a predetermined level. Generally, a pressure of about 10 Torr–50 Torr is preferably used. However, it depends on conditions such as the viscosity of paint to be used.

The relative position of the two panels 24a, 24b of the air-tight degree adjusting means 24 is adjusted by the driving means 24c so that the sealed container is rendered to a desired condition of pressure.

Then, the degree of opening of the valves 20a, 20c are respectively determined and the pump 20b is actuated, whereby the paint in the tank 2 is introduced into the upper section 14 of the container through the pipe line 20. The paint introduced in the upper section 14 falls into the lower section 16 through the plate 18 having the slits 18a. In this case, the flow rate of the paint to the lower section 16 depends on a pressure in the lower section, the surface area of openings of the plate, an air-tight degree determined by the air-tight degree adjusting means 24, a feeding rate of the paint, the viscosity of the paint and so on.

The paint flows down in a form of a plurality of thin streams (in a curtain-like form) which correspond to a pattern of the arrangement of the slits 18a. Accordingly, the paint flows in the lower section in a state that the surface area is sufficiently expanded in a thin film form. Therefore, bubbles contained in the thin streams of paint are expanded and quickly broken under the condition of a reduced pressure.

Since air in the lower section 16 is discharged through the pipe line 26 under the condition that the discharge of air is effected at a position separated from the flowing passage of paint by means of the partition plate 28, the flowing of the paint is not disturbed and there is no possibility that the paint enters into the pipe line 26. Thus, the paint flows down in a plurality of thin streams into the lower section 16 of the container while bubbles are removed, and the paint is stored in the bottom of the sealed container.

Thus, the paint without bubbles is supplied to the flow coater head 6a of the paint coating device by opening the valve 34b at an appropriate degree and by actuating the pump 34a.

The metallic plate P is coated with the paint flowing in a form of a curtain through the flow coater head 6a, and the paint which does not contribute to form a coating layer flows into the trough 8a and is recovered in the vessel 8b. The paint in the vessel 8b may be introduced in the upper section 14 through the pipe line 21 by opening the valve 21b at an appropriate degree and by actuating the pump 21a.

FIG. 6 shows the paint coating device being in the form of roll coater. As shown in FIG. 6, paint in a paint pan 54 is raised by a pickup roller 52 and successively transferred to a distributor roller 56 and a coating roller 50. The paint is coated on the metallic sheet P which is passed between the coating roller 50 and a backup roller 51. An overflow pipe is shown at 53 which leads to the paint recovering means 8.

When the level guage 22 detects that the surface level of the paint in the upper section 14 reaches a predetermined level, the flow rate regulate valve 21b in the pipe line 21 is automatically actuated to limit a flow rate of the paint to the upper section 14. When the level guage 32 detects that the surface level of the paint in the lower section 16 reaches a predetermined level, the flow rate regulate valve 20c in the pipe line 20 is automatically actuated to thereby limit the paint flowing in the upper section 14.

In the above-mentioned embodiment, description has been made as to the case that the paint recovered in the vessel 8b is directly introduced in the bubble removing apparatus 4. However, the recovered paint may be introduced in the tank 2 or may be separately processed.

Thus, in accordance with the present invention, a sufficient amount of paint can be continuously subjected to bubble removing operations depending on a requesite amount of paint to be sent to the paint coating device 6 so that the paint coating system can be operated continuously.

Figure 5A:
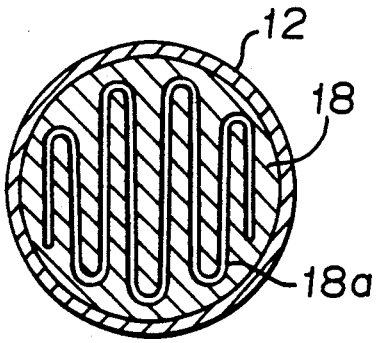
FIGS. 5*a*–5*d* are respectively cross-sectional views of embodiments of the plate having a single or a plurality of slit-like through holes.
Figure 5B:
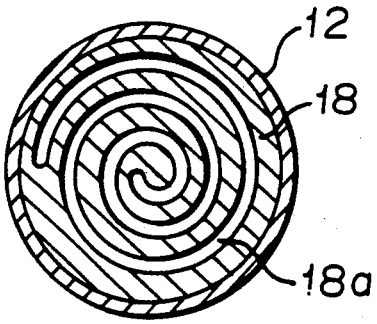
Figure 5C:
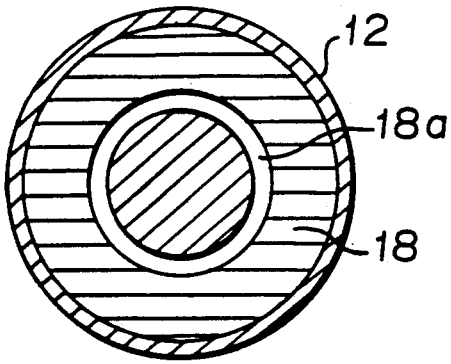
Figure 5D:
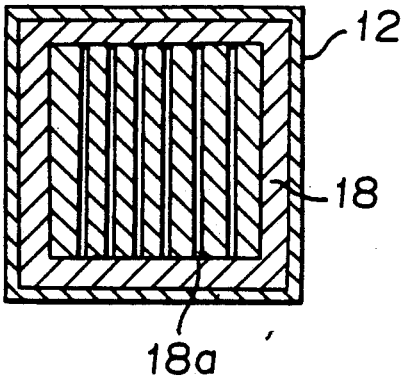

As to the plate having slit-like through holes, FIG. 3 shows one having slits which are arranged in parallel to each other. However, as shown in FIGS. 5a–5d, another pattern of opening may be used. Namely, a pattern of zig-zag form (FIG. 5a), a pattern of vortex form (FIG. 5b), a pattern of circle (FIG. 5c) may be utilized. FIG. 5d shows a pattern of slit in the plate 18 which is suitable for the sealed container having a rectangular shape in cross section.

In the following, Examples on the characteristics of the bubble removing apparatus of the present invention will be described.

EXAMPLE 1

20 l of a solution of clear acryl resin of a viscosity of 3 poise was put in an agitator and the solution of resin was stirred in the agitator so that the solution contains bubbles to show a white cloudy state. The white cloudy solution was subjected to a treatment of removing bubble by using the bubble removing apparatus as shown in FIGS. 2 and 3. The treatment of removing bubbles was conducted by the following conditions.

The width of the slit-like through holes: 0.15 mm

The height of the slit-like through holes: 80 mm

The total surface area of openings of the slit-like through holes: 0.96 $cm_2$

Pressure: 30 Torr

Flow rate: 8 l/min

Flowing time: 2.5 min

When the solution of the resin was observed after the bubble removing treatment, it was transparent and clear.

For comparison, the characteristics of the conventional bubble removing apparatus was examined.

EXAMPLE 2 (COMPARATIVE EXAMPLE)

20 l of the white cloudy solution used in Example 1 was put in the tank of a vacuum type bubble removing apparatus having a capacity of 100 l. The solution was stirred slowly at a pressure of 30 Torr to remove bubbles. After five minutes from starting the bubble removing treatment, the solution was still cloudy, and it took 20 minutes until it became the same state as that in the Example 1.

The characteristics of the paint coating system of the present invention was examined.

EXAMPLE 3

30 l of a solution type paint of white polyester resin of a viscosity of 3.2 poise (tradename "V Nitto #1500"

manufactured by Dai Nippon Toryo Co., Ltd.) was used. The paint was put in the system as shown in FIGS. 1–4, the paint was caused to flow through the paint coating device in the absence of a material to be coated. The paint was entirely recovered and was subjected to the bubble removing treatment, and the paint was recycled in the same manner as above.

The bubble removing apparatus was used in the following conditions.

The width of the slit-like through holes: 0.2 mm

The height of the slit-like through holes: 80 mm

The entire surface area of openings of the slit-like through holes: 1.28 $cm_2$

Pressure: 30 Torr

Flow rate of paint: 10.7 l/min

A paint curtain flowing from the paint coating device was observed and there was no breaking of the curtain during two hours continuous operations in a stable condition.

EXAMPLE 4 (COMPARATIVE EXAMPLE)

Continuous operations were conducted in the same manner as Example 3 except that pressure in the bubble removing apparatus was not reduced. In observation of the condition of the paint curtain at the paint coating device, the breaking of the curtain occured at a rate of 1/min for 10 minutes from the starting and the breaking of the curtain frequently occurred after that.

Thus, in accordance with the present invention, bubbles contained in paint can be easily and quickly enlarged and broken to thereby remove the bubbles by flowing the paint in a form of a curtain and by reducing the pressure in the bubble removing apparatus. Accordingly, air in the bubbles can be efficiently discharged. Accordingly, the bubble removing apparatus can be small-sized and can be continuously operated so that a sufficient amount of the paint is supplied through the paint coating device. With use of such a bubble removing apparatus, there is obtainable a paint coating system in a compact size, capable of continuous operations and of forming a coating layer having good quality.

We claim:

1. A system for coating paint which comprises:

a tank for storing a new paint;

a bubble removing apparatus comprising a sealed container, a plate having at least one slit which is disposed in said sealed container to divide the same into upper and lower sections and a pressure reducing means for removal of bubbles comprising an outlet valve connected to said lower section of the container;

a first paint feeding means to feed paint from said tank to a first inlet in said upper section of the sealed container;

a paint coating device for forming a coating layer on an object to be coated, said paint coating device being in communication with an outlet in said lower section of said sealed container so as to receive paint without bubbles; and a paint recovering means fluidly communicating with said paint coating device to recover or collect the paint which does not contribute to form said coating layer.

2. The system for coating paint according to claim 1, which further comprises a second paint feeding means for feeding said paint recovered by said recovering means to a second inlet in said upper section of the sealed container.

3. The system for coating paint according to claim 1 wherein said paint coating device is a curtain flow coater.

4. The system for coating paint according to claim 1 wherein said paint coating device is a roll coater.

5. The system for coating paint according to claim 1 wherein said upper section of said container comprises means for adjusting pressure in the upper section of said container.

6. The system for coating paint according to claim 1, wherein a first paint-feeding rate adjusting means is provided in said first paint feeding means, and a first paint surface level detecting means is disposed in said lower section of the bubble removing apparatus, whereby said first paint-feeding rate adjusting means is operated in response to a surface level of paint detected by said detecting means.

7. The system for coating paint according to claim 6, wherein a second paint-feeding rate adjusting means is provided in said second paint feeding means, and a second paint surface level detecting means is disposed in said upper section of the bubble removing apparatus, whereby said second paint-feeding rate adjusting means is operated in response to a surface level of paint detected by said detecting means.

* * * * *